United States Patent [19]

Paschedag

[11] 4,427,407

[45] Jan. 24, 1984

[54] CENTRIFUGAL BOWL SEPARATOR

[75] Inventor: Theodor Paschedag, Beckum, Fed. Rep. of Germany

[73] Assignee: Klockner-Humboldt-Deutz AG, Fed. Rep. of Germany

[21] Appl. No.: 326,707

[22] Filed: Dec. 2, 1981

[30] Foreign Application Priority Data

Dec. 4, 1980 [DE] Fed. Rep. of Germany ..... 3045672

[51] Int. Cl.[3] ..... B04B 1/08

[52] U.S. Cl. ..... 494/70; 494/76

[58] Field of Search ..... 494/27, 28, 29, 38, 494/68, 69, 70, 73, 74, 76, 79

[56] References Cited

U.S. PATENT DOCUMENTS 3,328,282 6/1967 Keith, Jr. et al. ..... 492/28

4,305,817 12/1981 Kohlstette ..... 492/28

FOREIGN PATENT DOCUMENTS 650595 9/1937 Fed. Rep. of Germany .

*Primary Examiner*—Robert W. Jenkins

*Assistant Examiner*—Arthur D. Dahlberg

*Attorney, Agent, or Firm*—Hill, Van Santen, Steadman & Simpson

[57] ABSTRACT

A centrifugal bowl separator contains a packet of conical discs having a series of feed discs with an intermediate disc of larger diameter disposed between each adjacent pair of feed discs. The substance to be treated enters a channel at the bottom of the disc packet and the channel discharges only above each feed disc. The material to be treated, namely both the heavy and the lighter components, flows in the spaces above the feed discs, and the heavier component is thrown against the underside of the intermediate disc and is flung from its larger periphery, while the lighter component flows along the upper surface of the feed disc and flows around its edge and out through the space below the feed disc. The spaces between the discs have conductive connection only at the radially outer area.

14 Claims, 7 Drawing Figures

CENTRIFUGAL BOWL SEPARATOR

BACKGROUND OF THE INVENTION

1. Field of the Invention

The invention relates to a centrifugal bowl separator, sometimes referred to as a solid bowl centrifuge.

2. Prior Art

The broad concept of using a packet of conical discs in a centrifugal bowl separator is well known. They enhance the clarifying capability in that they separate the material being treated into a multiplicity of layers moving between the individual discs, and thus they shorten the length of the precipitation path for the denser substances. Such packets of discs are particularly suited for the separation of substances having a low precipitation rates such as yeasts, bacteria and the like. During the settling operation, the substances to be separated must be conducted in such a manner that turbulences are avoided, or else there would be a danger that particle already settled would be entrained into the flow of the lower density substances, whereby the separating capability of the centrifuge would be adversely affected.

A conical disc insert for centrifugal drums is shown in German Pat. No. 25 45 754 which discloses normal discs and intermediate discs which form ascending channels disposed at a distance from the axis of rotation near the outermost area for the distribution of a liquid containing solids to the spaces between the individual discs. With this arrangement, the intermediate discs have a smaller inside diameter than the normal discs. In such apparatus, the coarser solid particles are immediately removed from the rising channels into a space where solids are collected, but the finer solid particles are entrained into the spaces between the discs by the partially clarified liquid which is flowing downwardly, whereby, as a function of the settling rate, sedimentation at the lower side of the next highest normal disc can occur at various locations along the flow path of the liquid. With this arrangement, the inner radial area at the intermediate discs between two normal discs has a counter-flow of solids and liquids, whereby turbulences are unavoidable.

A further conical disc insert for a centrifuge is shown in German Pat. No. 650,595. In this structure, the discs form ascending channels for the substances to be separated in an area adjacent to the axis of rotation. The solids centrifuged onto the upper side of a disc and the clarified liquid thereabove thereby flow in co-current flow with respect to one another proceeding from a radially inside area. At a radially outside area, the discs have a series of aligned openings, surrounded by collars and forming discharge channels for the clarified liquid. The collars function to protect the flow of solids moving toward the outside from turbulence due to the ascending liquid stream. However, as a function of the thickness of the layer of solids sliding over the disc, as well as its grain size and settling rate, turbulences and the like can hardly be prevented due to the pressure distribution to be expected in the proximity of the collars.

SUMMARY OF THE INVENTION

It is therefore an object of the invention to provide a centrifugal bowl separator having a packet of discs constructed in such manner that turbulences of an already settled solids component, due particularly to cross-flows or counter-flows, are avoided. Thus the clarifying capability of the centrifuge is significantly improved in comparison to prior embodiments.

To this end, the disc packet is composed of feed discs and intermediate discs in which the spaces below the feed discs and the spaces above the feed discs have a conductive connection to one another only in an outer area, remote from the axis of rotation. The packet has channels with discharge openings which supply fluid only to the spaces above a feed disc. With this arrangement, substances to be separated are introduced into the separator with a complete spatial separation from the liquid component being discharged. A settling process which has already begun during passage through the disc packet can continue without disruption because of the co-current flow of the substances to be separated at the input side; a turbulence due to the liquid flowing back is prevented. With this arrangement, the clarifying capability, particularly the separation effect, is significantly improved over prior devices.

In a particular embodiment of the invention, spacing strips are disposed between the feed and intermediate discs, the spacing strips having different axial extents so that the spaces above a feed disc are axially greater than the spaces below the feed discs. Because the solids component or denser component has been removed, the volume of the less denser component that needs to be conducted is lessened, and therefore the space beneath the feed disc can be smaller. Moreover, the settling rate of the solids is one of the factors that determines the maximum flow rate above a feed disc, but during reflux flow, this factor is absent and therefore a higher flow rate of the separated less dense material can be utilized. This factor enables a disc packet which is particularly compact in size, thus enabling the size of the centrifugal bowl separator to be held to a minimum.

Many other advantages, features and additional objects of the present invention will become manifest to those versed in the art upon making reference to the detailed description and the accompanying sheets of drawings in which preferred structural embodiments incorporating the principles of the present invention are shown by way of illustrative example.

ON THE DRAWINGS

AS SHOWN IN THE DRAWINGS

Figure 1:
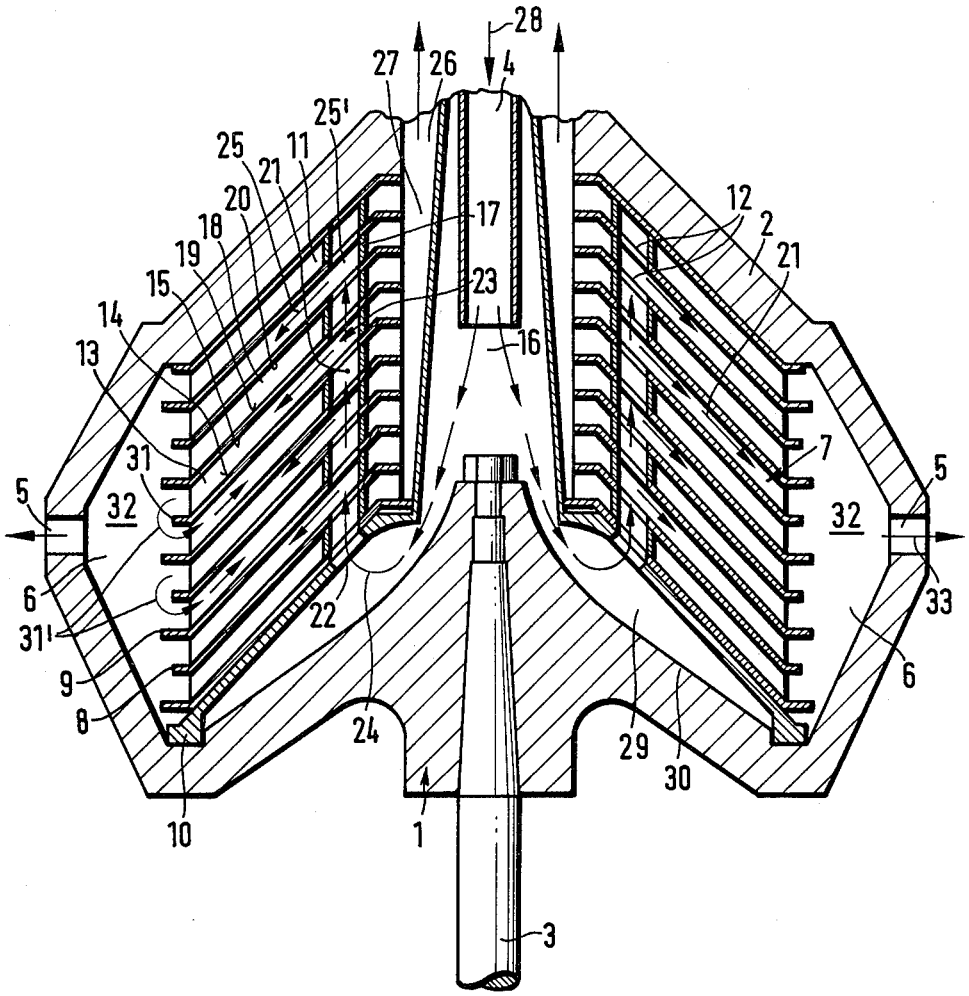
FIG. 1 is a longitudinal cross-sectional view of a centrifugal bowl separator provided in accordance with the principles of the present invention.

As shown in FIG. 1, a centrifugal bowl separator 1 according to the invention includes a symmetrical housing 2 containing a packet of conical discs generally indicated at 7. The housing 2 is rotatably supported on a shaft 3 to be driven thereby while a supply line 4 provides an axial inlet 16 into the housing 2. The housing has a series of outlets 5 at the maximum periphery thereof. Such outlets may be formed as a continuous gap. Associated with the outlets 5 is a conventional external valve structure enabling selected withdrawal of the denser separated material. The less dense separated material is collected in a zone 27 for upward flow through a central annular outlet 26.

The packet of conical discs 7 includes a series of feed discs 8 and a series of intermediate discs 9 disposed upon a distributor body 10. The feed discs 8 have a smaller outside diameter than the intermediate discs 9, and both of types of discs are provided with radial spacing strips 11. The axial extent of the radial spacing strips 11 that determines the spacing above the feed discs 8 is greater than the axial spacing provided by the spacing strips 11 that are disposed below the feed discs 8. In the drawing, the spaces above the feed discs are identified by the numeral 13 and these lie between discs surfaces 14 and 15, while the spaces below the feed disc are identified by the numeral 18, such spaces lying between the disc surfaces 19 and 20.

The lower surface of the distributor body 10 and the upper inner surface 30 of the housing 2 generally define a chamber 29 into which incoming substance flows for distribution through a series of discharge openings 22 which are disposed at or near the lower end of the distributor body 10.

Figure 4:
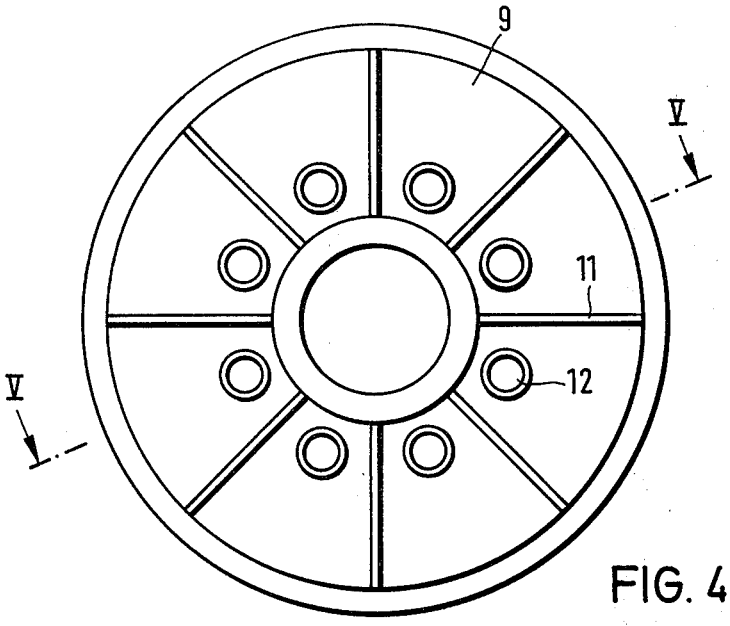
FIG. 4 is a plan view of an intermediate disc.
Figure 5:
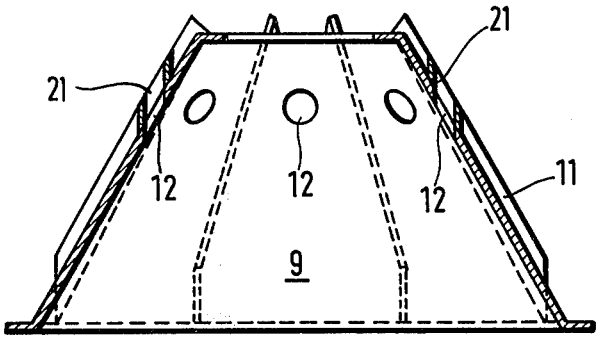
FIG. 5 is a cross-sectional view taken along line V—V of FIG. 4.

In registration with each discharge opening 22, there is a channel generally indicated at 23. Each channel 23 distributes flow only to the spaces 13 lying above the feed discs 8, each channel 23 being straight, parallel to the rotational axis of the separator 1, and extends through conical portions of the discs 8, 9. The channels 23 and the discharge openings 22 are disposed uniformly about the rotational axis, as are also the spacing strips 11 as shown in each of FIGS. 2 and 4. Each disc 8, 9 is provided with an opening 12 which forms a part of each channel passing therethrough.

Figure 2:
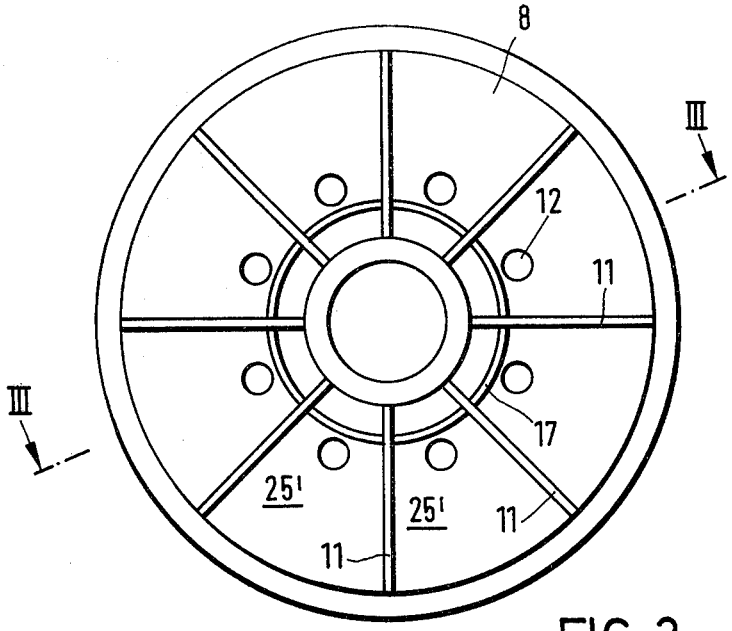
FIG. 2 is a plan view of an individual feed disc.
Figure 3:
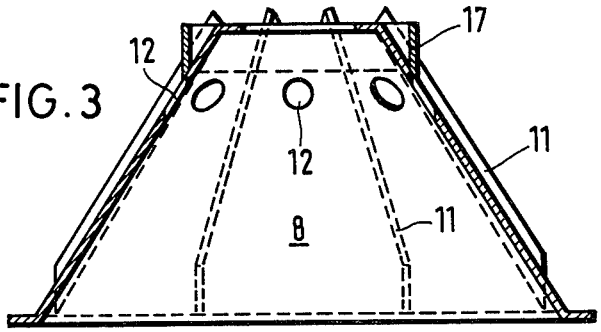
FIG. 3 is a cross-sectional view taken along line III—III of FIG. 2.

In this embodiment, to partially define a channel 23, a series of pipes 21 connects the opening 12 in the intermediate disc 9 to opening 12 in the feed disc 8 located immediately thereabove. The pipe 21 may be formed integral with one of such discs. Thus the pipes 21 provide a sealed passage through the spaces 18, and the absences of such pipes in the spaces 13 enable fluid to be discharged such as at the numeral 25' and to flow radially outwardly as shown by the arrow 25. Within each of the spaces 13 lying above the feed discs 8, there is disposed an annular wall or ring 17 which, as best shown in FIG. 2, lies between the openings 12 and the rotational axis. The ring 17 thus precludes any flow of liquid from the opening 21 in a radially inward direction. The ring 17 as shown in FIG. 2 extends upwardly from the feed disc 8. If desired, the disc could be disposed on the lower side of the intermediate disc 9 and extend downwardly therefrom.

The housing 2 is shown in a partially diagramatic form in that it actually is made up of more than one component, the parts being held together by means not shown. At least one horizontal parting line is disposed radially outwardly of the outer diameter of the intermediate discs 9 so that the packet 7 of conical discs, including the distributor body 10 may be installed and clamped as a unit with the lower surface of the distributor body 10 having a fluid tight connection with the housing 2 and the upper part of the housing 2 having a fluid tight clamping relation with the uppermost disc 8.

The suspension to be clarified enters through the supply pipe 4 into the axial inlet 16 of the separator 1 and flows to the chamber 29, entering the discharge openings 22 as shown by the curved arrow 24. From there it rises in the channels 23, part of which is discharged between the radial spacing strips 11 of the feed discs 8 for radially outwardly and downward flow as indicated by the arrow 25. At this point in the operation, a settling process is accomplished in the spaces 13 such that the solids component, due to the centrifugal force field, moves away from the axis of rotation at the lower sides of the intermediate discs 9, while the liquid component moves away from the axis of rotation along the upper sides of the feed discs 8. Thus the liquid component and the solids move between the discs in co-current flow. The flow rate continuously decreases because the cross section of the spaces 13 gradually increase in size. Therefore the separating operation primarily occurs in those areas which lie the farthest away from the axis of rotation. A deflection of the liquid component or of the clarified component occurs as shown by the arrows 31' at the end area or edge 31 of a feed disc 8. The solids component collects in the outermost areas 32, 6 of the housing 2 under the influence of the centrifugal force field. The solids component is dicharged from the area 32 through the discharge openings 5 as shown by the arrows 33. The liquid component flowing as shown by the arrows 31' flows through the spaces 18 and around the pipes 21 in its clarified state to the discharge channel or collection area 27 for discharge at the outlet 26.

Figure 7:
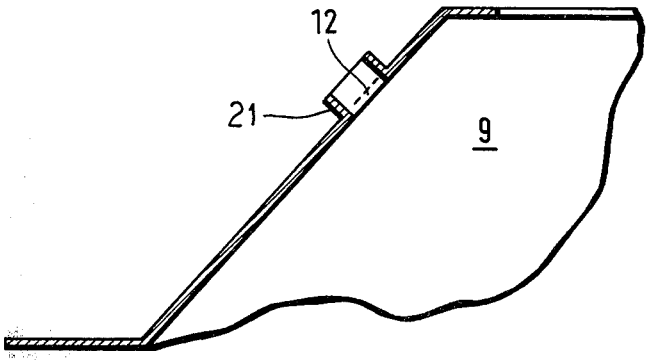

If desired, the disc openings 12 and the pipes 21 may have an oblong cross section, and if desired, the pipes may have their axis perpendicular to the conical portion of the disc as shown in FIG. 7.

Figure 6:
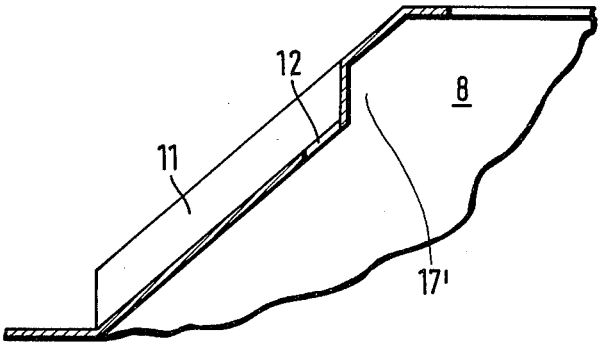
FIGS. 6 and 7 are fragmentary cross-sectional views of modified forms of feed and intermediate discs respectively.

A further embodiment of the novel feed disc 8 is shown in FIG. 6. In this embodiment, the annular wall 17 is formed by a surface projecting out of the surface of the feed disc and extending in an axial direction. The conical generated surface of the feed disc is bent down in this area to provide such surface. Again a spacing strip has been identified by the reference numeral 11. Naturally, a complemental design of the profile of the intermediate disc is feasible.

FIG. 7 shows an embodiment of an intermediate disc 9 in which the pipe length 21 is formed by the outside neck of an opening 12. This construction has manufacturing advantages.

Although various minor modifications might be suggested by those versed in the art, it should be understood that I wish to embody within the scope of the patent warranted hereon, all such embodiments as reasonably and properly come within the scope of my contribution to the art.

I claim as my invention:

1. A centrifuge bowl separator for separating substances with different densities, comprising:

a rotatably supported hollow housing having a form which is symmetrical about its rotational axis, having an axial inlet for the substances to be separated, a peripherally disposed outlet in the housing for the denser substances, and a central outlet for the less dense substances; and a packet of axially spaced conical discs communicating said inlet with said outlets, and including a series of feed discs having an intermediate disc beneath each said feed disc, the spaces between said discs having a conductive connection to one another only in a radially outer area with respect to the axis of rotation, and there being channels extending through said discs that communicate said inlet only into those spaces lying at the upper sides of said feed discs.

2. A separator according to claim 1, including a distributor body supported in said housing and communicating said inlet with said channels, said feed discs being fixedly attached to each other in succession and supported on said distributor body.

3. A separator according to claim 1, said feed discs having a smaller diameter than said intermediate discs, and said discs being imperforate except at said channels.

4. A separator according to claim 1, including a distributor body supported in said housing and communicating said inlet with said channels, said feed discs having a smaller diameter than said intermediate discs, and said discs being imperforate except at said channels.

5. A separator according to claim 1, including a distributor body supported in said housing and communicating said inlet with said channels, said channels being straight, and being parallel and disposed uniformly about the axis of rotation, said distributor having a series of discharge openings near its lower end, one for each said channel.

6. A separator according to claim 1, there being a conical separating space defined by each upper side of a feed disc and the lower side of the intermediate disc immediately thereabove, the flow direction in said separating space being from said channels toward the outer periphery of said disks; and a conical outlet space for the purified liquid defined by each lower side of a feed disc and the upper side of the intermediate disc immediately therebelow, the flow direction of the purified liquid in said outlet space being from the periphery of a disc toward the central outlet.

7. A separator according to claim 16, each said conical separating space being defined by spacing strips secured to the lower side of said feed discs and a closed annular wall, and each said conical outlet space for the purified liquid being defined by spacing strips secured to the lower side of said intermediate discs and the outer side of a pipe section whose interior forms part of one of said channels.

8. A separator according to claim 6, said channels for feeding being defined by pipe sections in said intermediate discs, and openings in the feed discs disposed above each other on a straight line, said feed channels enabling an in-flow of the suspension to be separated only into said respective separating spaces.

9. A separator according to claim 6, said channels extending through conical portions of said discs, said feed discs having a marginal outer portion lying in a plane, and having a lesser diameter than that of said intermediate discs, whereby the discharge of the purified fluid is promoted before it could reach the outermost area of said housing which is more enriched with solids.

10. A centrifuge bowl separator for separating substances with different densities, comprising:

a rotatably supported hollow housing having a form which is symmetrical about its rotational axis, having an axial inlet for the substances to be separated, a peripherally disposed outlet for the denser substances, and a central outlet for the less denser substances;

a packet of axially spaced conical discs communicating said inlet with said outlets, and including a series of feed discs having an intermediate disc beneath each said feed disc, the spaces between said discs having a conductive connection to one another only in a radially outer area with respect to the axis of rotation, and there being channels extending through said discs that communicate said inlet only into the spaces lying at the upper sides of said feed discs; and radial spacing strips disposed between each pair of adjacent ones of said discs, said strips having different axial extents such that the space above a feed disc is axially longer than the space below such feed disc.

11. A centrifuge bowl separator for separating substances with different densities, comprising:

a rotatably supported hollow housing having a form which is symmetrical about its rotational axis, having an axial inlet for the substances to be separated, a peripherally disposed outlet for the denser substances, and a central outlet for the less dense substances; and a packet of axially spaced conical discs communicating said inlet with said outlets, and including a series of feed discs having an intermediate disc beneath each said feed disc, the spaces between said discs having a conductive connection to one another only in a radially outer area with respect to the axis of rotation, and there being channels extending through said discs that communicate said inlet only into the spaces lying at the upper sides of said feed discs, said channels including an opening in each said disc for each channel;

a pipe connecting said opening in each intermediate disc to said opening in each feed disc disposed immediately thereabove; and an annular wall connecting each feed disc to each intermediate disc disposed immediately thereabove, said wall lying between said openings and the rotational axis.

12. A separator according to claim 11, said wall forming an upwardly projecting surface on said feed disc.

13. A separator according to claim 11, said wall forming a downwardly projecting surface on said intermediate disc.

14. A separator according to claim 11, said pipe being integral with one of said discs whose opening it interconnects.

* * * * *